US005224685A

United States Patent [19]

Chiang et al.

[11] Patent Number: 5,224,685

[45] Date of Patent: Jul. 6, 1993

[54] POWER-SAVING CONTROLLER FOR TOILET FLUSHING

[76] Inventors: Sing Chiang, 4th Fl., No. 19, Lane 60, Chung Hua Rd., Taipei Hsien, Taiwan; Chin H. Hsieh, No. 1, Lane 103, Yung Tai St., Chungli City, Taoyuan Hsien, Taiwan

[21] Appl. No.: 967,171

[22] Filed: Oct. 27, 1992

[51] Int. Cl.[5] ..... F16K 31/02; E03C 1/05

[52] U.S. Cl. ..... 251/129.04; 4/623; 4/DIG. 3; 4/304

[58] Field of Search ..... 251/129.04; 4/623, DIG. 3, 4/304

[56] References Cited

U.S. PATENT DOCUMENTS 4,941,219 7/1990 Van Marcke ..... 251/129.04 X 5,031,258 7/1991 Shaw ..... 4/623

*Primary Examiner*—Arnold Rosenthal

*Attorney, Agent, or Firm*—Poms, Smith, Lande & Rose

[57] ABSTRACT

A power-saving controller for toilet flushing includes a passive pyroelectricity detecting device connected to a microcomputer, which is further connected to an active infrared detecting device, and a switch device such that when a user is nearby the toilet in a relatively long distance, the passive detecting pyroelectricity detecting device will respond to generate a first triggering signal to the microcomputer, which in turn generates a second triggering signal to actuate the active infrared detecting device to detect whether a user is using the toilet, if so, then the active infrared detecting device will respond to generate a third triggering signal to feed back to the microcomputer, which in turn enables a timer to count therein, until the user leaves the toilet position, causing the third triggering signal to terminate, which in turn triggers the microcomputer to programmably generate a fourth triggering signal to turn on the switch device, which in turns activates a pumping motor connected thereto to pump water to flush the toilet.

7 Claims, 7 Drawing Sheets

POWER-SAVING CONTROLLER FOR TOILET FLUSHING

FIELD OF THE INVENTION

This invention relates to a power-saving controller for toilet flush particularly to one which has a passive sensor and an active sensor such that the passive sensor can sense in a normal time and when a user arrives the passive sensor will detect the presence of the user and further trigger the active sensor to function to further trigger a pumping motor to release predetermined amount of water to clean the toilet.

BACKGROUND OF THE INVENTION

A toilet flush controller used at the present time usually uses an active infrared sensor which has an infrared transmitter and an infrared receiver to transmit infrared to detect whether a user occupies the front of the toilet. If a user is using the toilet, the infrared transmitted from the active sensor will be reflected from the user's body and received by the receiver, and the receiver will further trigger a microcomputer to activate the toilet to flush. The active sensor needs to continuously transmit infrared outward, which requires a relatively high power and dissipates too much energy, for example, a 30-centimeter distance from a transmitter requires supplied impulse current up to 1 ampere. The conventional toilet flush controller usually requires an AC power supply to provide power because of its high power dissipation factor. Moreover, the wiring between the AC power and the controller is cumbersome.

It is required to have one kind of toilet flush controller which dissipates less power than the conventional one, therefore merely several batteries are enough for the power dissipation thereof.

SUMMARY OF THE INVENTION

The present invention provides a toilet flushing controller which includes a passive pyroelectricity detecting means for detecting a user in a relatively long distance from the toilet and triggering an active infrared detecting means for detecting in a relatively short distance and triggering a pumping motor to pump a predetermined amount of water to clean the toilet.

It is an object of the present invention to provide a toilet flushing controller for power saving because the passive pyroelectricity detecting means thereof only consumes a little power.

It is another object of the present invention to provide a toilet flushing controller for providing a long distance detection and a short distance detection.

DETAILED DESCRIPTION OF THE PREFERRED EMBODIMENTS

Figure 5:
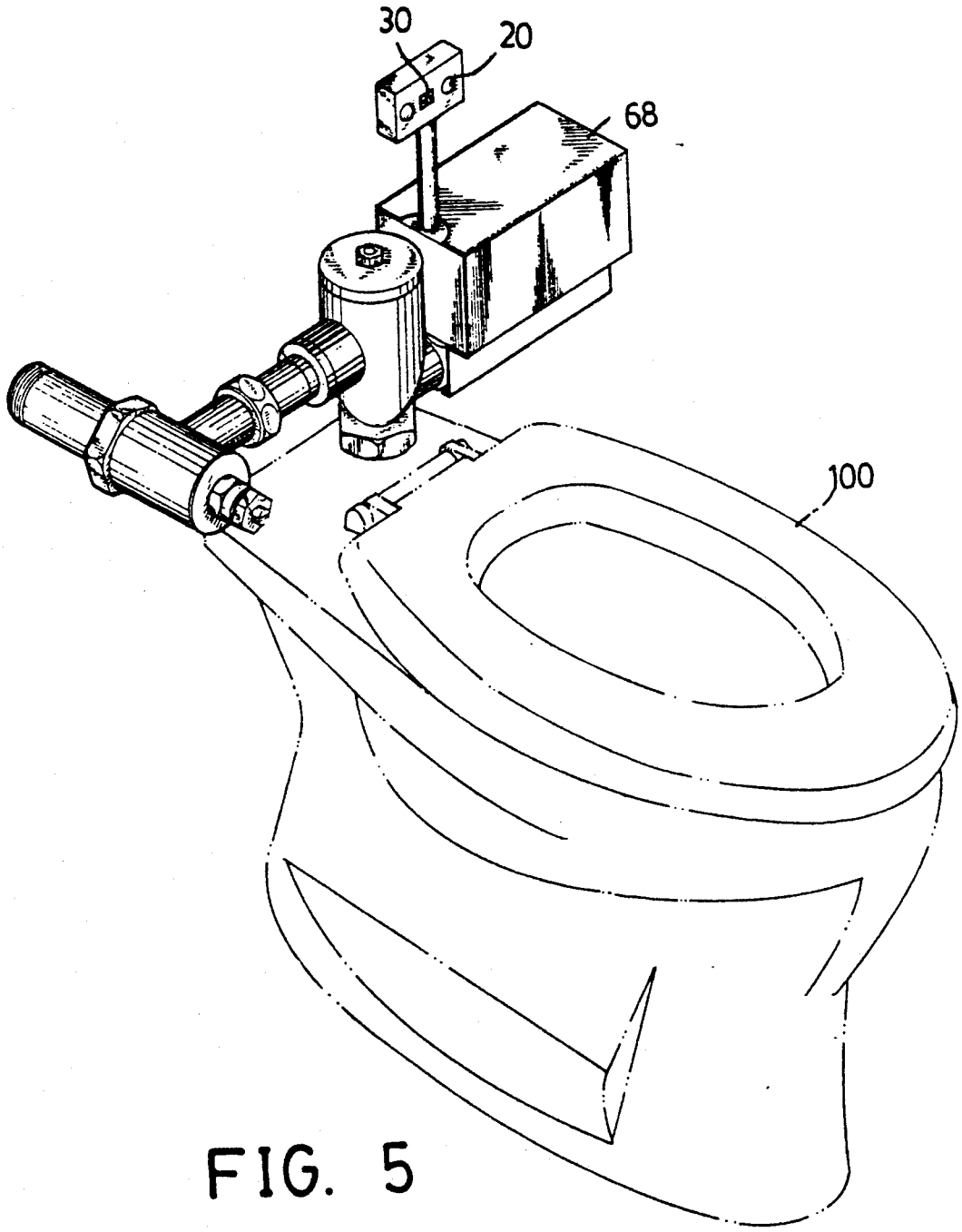
FIG. 5 illustrates the assembly adapter of FIG. 4 mounted on a conventional tankless-type toilet flushing device.

Roughly referring to FIG. 5, a passive pyroelectricity detecting means 20 and an active infrared detecting means 30 are installed near a toilet 100 with a distance about 50 centimeters. If a user is using the toilet 100, there is a relatively short distance such as forty centimeters from the user to the detecting means 20 and 30. The infrared detecting means 30 can detect a user from about sixty centimeters. The passive pyroelectricity detecting means 20 can detect the user from a relatively long distance such as two meters.

Figure 1:
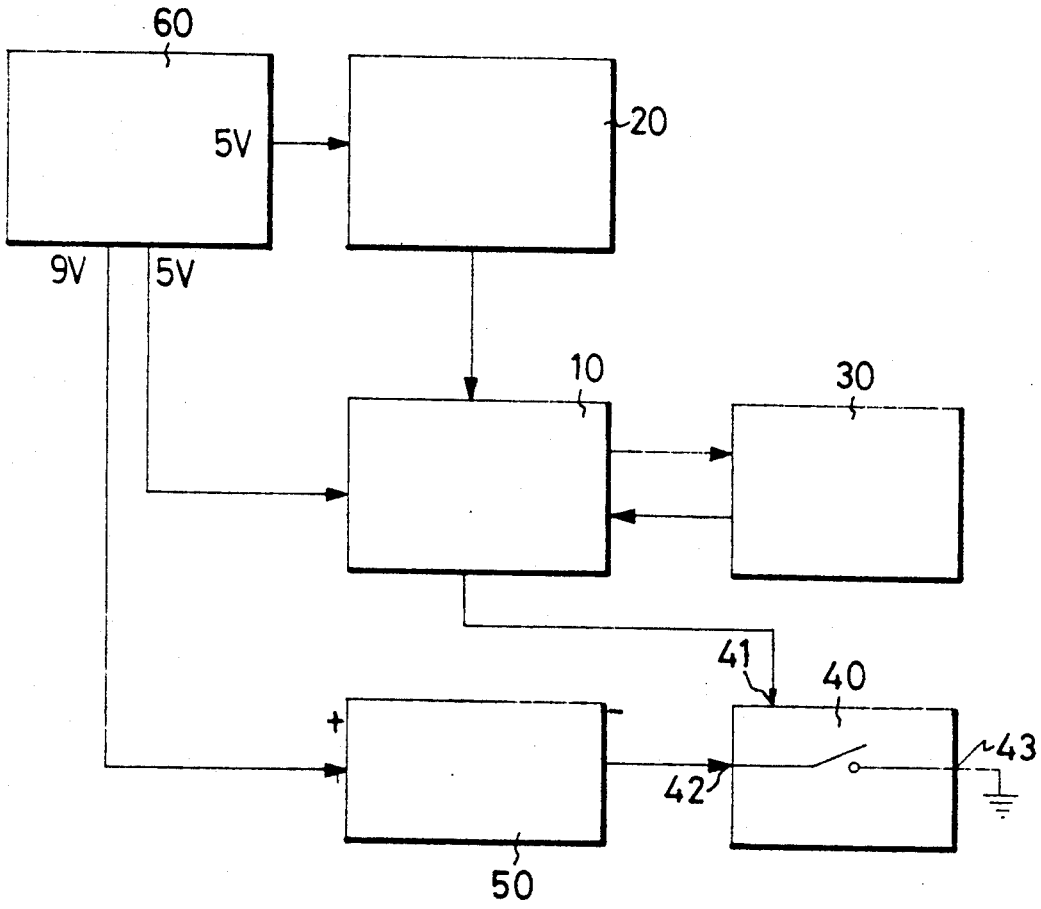
FIG. 1 is block diagram of toilet flushing controller in accordance with the present invention.

Referring to FIG. 1, a power-saving controller for toilet flush comprises: a DC power supply 60, a passive pyroelectricity detecting means 20, a microcomputer 10, an active infrared detecting means 30, a switch means 40, and a pumping motor 50. Normally the pyroelectricity detecting means 20 is on for sensing a user nearby. If a user appears in the effective detecting range of the pyroelectricity detecting means 20, the pyroelectricity detecting means 20 will trigger the microcomputer 10, which in turn triggers the active infrared detecting means 30 from off to on. Normally the pumping motor 50 stays in a non-flushing status which is also the original position of a eccentric shaft of the motor as will be described later. The DC power supply 60 having a 5-volt output and a 9-volt output, is used to provide required power for the whole controller. The pyroelectricity detecting means 20 is used to sense temperature from a user nearby and respond to generate a first triggering signal to the microcomputer 10. The microcomputer 10 is coupled to the pyroelectricity detecting means 20 for responding to the first triggering signal and generating a second triggering signal to turn on the active infrared detecting means 30. The active infrared detecting means 30 is coupled to the microcomputer 10 for responding to the second triggering signal and being activated to detect whether a user is in toilet position. When the active detecting means 30 detects a user is in toilet position, it will generate a third triggering signal to feed back to the microcomputer 10 to start a program for time counting until the user leaves, eliminating the third triggering signal, stopping counting of the timer, and causing the microcomputer 10 to output a fourth triggering signal to trigger the switch means 40 on and cause the motor 50 to rotate for a half circle and stays in a flushing status to cause a conventional toilet flushing device to clean the toilet. When the motor 50 stays in the flushing status, the microcomputer 10 programmably compares the counted value with a predetermined value such as one minute. If the counted value is greater than the predetermined value (one minute), the motor 50 will stay in the flushing status for a relatively long time period such as 15 seconds and then rotates for another half circle back to original position, returning to non-flushing status; otherwise the motor 50 will stay in the flushing status for a relatively short time period such as 3 seconds and then rotates for another half circle back to original position, returning to non-flushing status. Note that the motor 50 is linked with a gear assembly (not shown) for increasing the torque effect thereof.

The switch means 40 has a triggering terminal 41 coupled to the microcomputer 10 for responding to the fourth triggering signal and being activated to be conductive to a ground. The motor 50 has a positive terminal connected to the 9-volt terminal of the DC power supply 60 and a negative terminal connected to the switch means 40 such that when the switch means 40 is conductive to ground, the motor 50 rotates as long as the switch means 40 is conductive.

Figure 2:
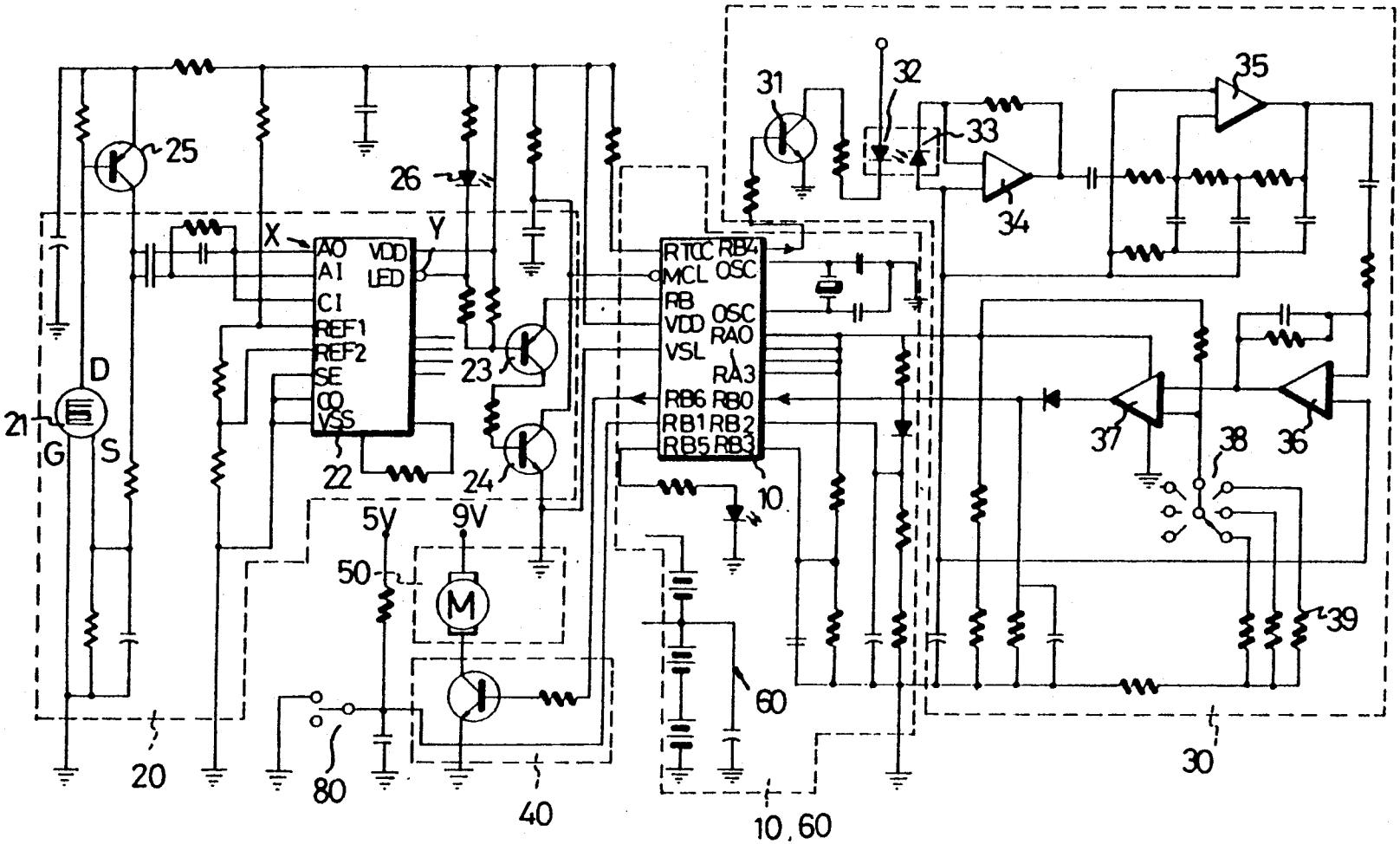
FIG. 2 is a circuit diagram of FIG. 1.

Referring to FIG. 2, the controller is shown in more detail. The microcomputer 10 comprises: a first input terminal RB7 for programmably responding to the first triggering signal from the pyroelectricity detecting means 20 and programmably enabling the microcomputer 10 to generate the second triggering signal; a first output terminal RB4 for outputting the second triggering signal after the microcomputer 10 is triggered by the first triggering signal; a timer being programmably controlled to count when the microcomputer 10 is triggered by the third triggering signal from the active infrared detecting means 30; a reset terminal MCLR for responding to a low input to clear the microcomputer 10; a second input terminal RB0 for receiving the third triggering signal and responding to trigger the timer to start to count and responding to the termination of the third triggering signal and causing the timer to stop counting; a second output terminal RB6 for responding to the stopping of the timer and outputting the fourth triggering signal to activate the motor 50 to rotate for a half circle and stay in a flushing status, and the fourth triggering signal terminates. The procedure of the microcomputer 10 is guided by a program therein. When the motor 50 stays in the flushing status, the program will compare the counted value with a predetermined value. If the counted value is greater than the predetermined value, the microcomputer 10 will let the motor 50 stay in the flushing status for a relatively long period of time such as 15 seconds, otherwise a relatively short period of time such as 3 seconds is used. After the flushing time period, the microcomputer 10 further outputs the fourth signal from the second output terminal RB6 and activates the motor 50 to rotate for another half circle and back to original position. A micro-switch 80 is used to limit the motor 50 to stop at the original position. The detail for the micro-switch 80 is well known and is not described in detail herein.

The pyroelectricity detecting means 20 comprises a pyroelectricity sensor 21, a first transistor 25, a converter 22, a light emitting diode 26, a second transistor 23 and a third transistor 24. The pyroelectricity sensor 21 is connected to a first triggering terminal of the first transistor 25. The first transistor 25 has an output terminal (collector) connected to the converter 22. The converter 22 has an output terminal LED connected to a cathode of the light emitting diode 26 and also to a triggering terminal of the second transistor 23. The second transistor 23 has a first output terminal (emitter) connected to the first input terminal RB7 of the microcomputer 10 and a second output terminal (collector) connected to a triggering terminal of the third transistor 24. The third transistor 24 has an output terminal (collector) connected to the reset terminal MCLR of the microcomputer 10. If a user comes nearby the toilet, encountering the pyroelectricity sensor 21 for a relatively long distance, the pyroelectricity sensor 21 will detect the existence of the user, causing the first transistor 25 to be on and to send a pulse to the converter 22, which in turn generates a low pulse to activate the light emitting diode 26 on, and to trigger the second transistor 23 and the third transistor 24 on. When the second transistor 23 on, the first triggering signal is generated and sent to the first input terminal RB7 of the microcomputer 10 which in turn, sends out a second triggering signal to activate the active infrared detecting means 30. When the third transistor 24 is on, a low input is generated and sent to the reset terminal MCLR of the microcomputer 10 to reset the microcomputer 10. However, the relatively long distance of the sensing range of the pyroelectricity sensor 21 is not limited to a specific value.

The active infrared detecting means 30 comprises a fourth transistor 31, an infrared transmitter 32, an infrared receiver 33, a first filter 34, a second filter 35, a third filter 36, a plurality of reference resistors 39, a multi switch 38, and an amplifier 37. The fourth transistor 31 has a triggering terminal (base) connected to the first output terminal RB4 of the microcomputer 10, and an output terminal connected to the infrared transmitter 32, which further couples to the infrared receiver 33 by reflected infrared from a user in the toilet position. The infrared receiver 33 is coupled between the inverting terminal and the non-inverting terminal of the first filter 34. The first filter 34 is cascadedly connected to the second filter 35, which in turn cascadedly connected to the third filter 36, which in turn cascadedly connected to the amplifier 37.

The plurality of resistors 39 cooperate with the multi-switch 38 to adjust the gain of the amplifier 37. The output of the amplifier 36 is connected to the second input terminal RB0 of the microcomputer 10. When the second triggering signal is outputted from the first output terminal RB4 of the microcomputer 10, the fourth transistor 31 is triggered to be on, which in turn triggers the infrared transmitter 32 to transmit an infrared signal to a user's body and is reflected therefrom and received by the infrared receiver 33, through the filters (34, 35, and 36) and the amplifier 37, thereby generating the third triggering signal and coupling to the second input terminal RB0 of the microcomputer 10 to start the timer to count until the third triggering signal terminates. The third triggering signal terminates when the user leaves the toilet stopping to reflect infrared to the infrared receiver 33. When the user leaves for a distance beyond the sensing distance of the pyroelectricity sensor 21, the latter will respond to turn off the transistor 25, and turn off the second transistor 23 and the third transistor 24. Since the second transistor 23 is off, the first output terminal RB4 of the microcomputer 10 outputs a low level and turns off the fourth transistor 31, which further turns off the transmitter 32, thereby saving power. Therefore, the controller returns to a normal mode for sensing another user only by the pyroelectricity sensor 21.

The switch means 40 is an NPN transistor, where the base thereof is connected to the second output terminal RB6 of the microcomputer 10, the emitter thereof to ground, and connector thereof to the negative terminal of the motor 50.

Figure 3:
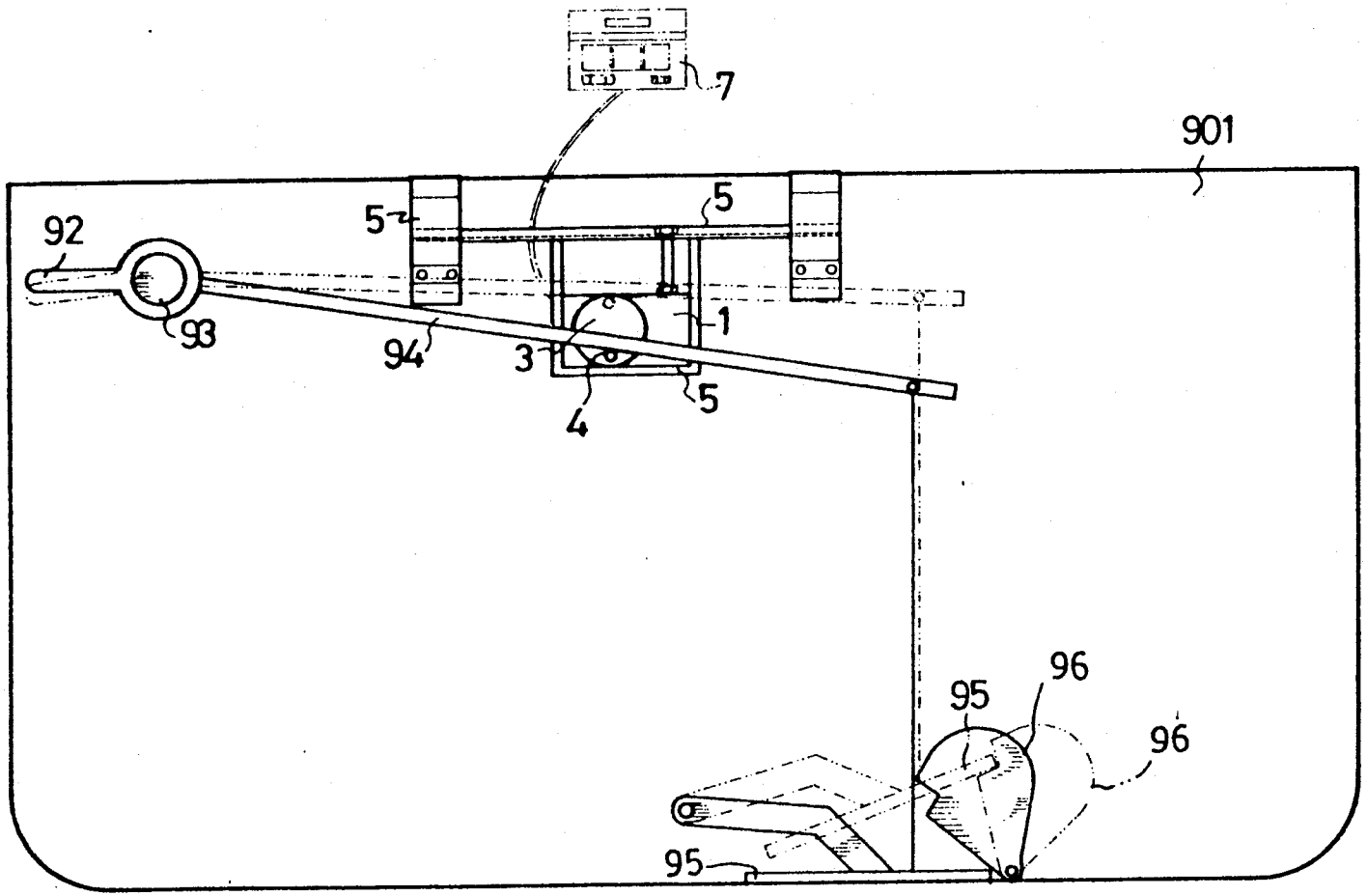
FIG. 3 is a simplified structure of tank-type toilet flushing structure used at the present invention.

Referring to FIG. 3, a simplified tank-type toilet flushing mechanism is shown. A tank 901 is filled with water. Outside the tank 901 is a handle bar 92 engaged to a pivot 93. The pivot 93 is arranged at a periphery of the tank 901 and is further engaged with an arm 94 inside the tank 901. The arm 94 has one end engaged with the pivot 93 and the other end engaged to a valve 95 via a stainless wire 96. Thus, when a user presses the handle bar 92, the valve 95 will be lifted and engaged to the catch 96 as shown in dotted line, and the water will go out via the valve 95 until substantially no water remains, causing the catch 96 release the valve 95, thus the latter back to block the outlet and in the mean time, new water will fill the tank again. As mentioned, this is merely the manual operation of the toilet flushing mechanism, which is well known. For practicing the present invention, the user has to remove the catch 96 in order to let the pumping motor 50 control the valve 95 independently. In the present invention, the toilet flushing controller is installed in a first box 7 which is electrically coupled to a pumping motor 50 (shown in FIG. 4B) which includes a disk 3 at the center thereof, thus the disk 3 synchronously rotates with the motor 50. The motor 50 is arranged inside a second box 1 to be water proof. A frame 5 is used to support the second box 1 and the motor 50. An eccentric shaft 4 protruding from the front face of the disk 3 contacts with the arm 94. When the controller functions by detecting the presence of a user, the disk 3 rotates, causing the arm 94 to lift the valve 95 as shown in dotted line and evacuate the tank water. Normally, the eccentric shaft 4 of the disk 3 stays in six o'clock position, thus the valve 95 blocks the outlet therebelow and no water is flushed to the toilet bowl. If the eccentric shaft 4 of the disk 3 is activated to stay in twelve o'clock position, the valve 95 is lifted and water flushes to the toilet bowl as shown in the dotted line of FIG. 3. If a user stays in the toilet position for less than one minute, then after he leaves, the eccentric shaft 4 of the pumping motor 50 will be activated to stay in twelve o'clock position for 3 seconds, during which time water will go out from the tank to flush the toilet. If a user stays in the toilet position more than one minute, then after he leaves, the eccentric shaft 4 of the pumping motor 50 will be activated to stay in twelve o'clock position for 15 seconds, during which time water will go out from the tank to flush the toilet. The toilet flushing mechanism as introduced above is merely a simple case for the controller and is not claimed herein. However, the controller as mentioned is not limited to any specific toilet flushing mechanism.

The controller as mentioned may also be used in a tankless-type toilet flushing device as shown in FIGS. 4A to 6. However, a mechanical adapter device is required to facilitate the practice of the controller on the tankless-type toilet flushing device. In this embodiment, the pumping motor 50, the disk 3, and the eccentric shaft 4 may also be used. Of course, one may use other types of motors. In this example, the normal (initial) position of the eccentric shaft 4 is contrary to the that of the tank-type toilet flushing device as will be described in more detail later.

Before introducing the adapter, it is better to understand that the tankless-type toilet flushing device has a handle 601 pivotally engaged to a tubular body portion 602 of the toilet flushing device such that when a user depresses the handle 601, the water will be provided to flush the toilet. Therefore, it is required to provide a mechanical adapter to interface between the controller circuit and the tankless-type toilet flushing device.

Figure 4A:
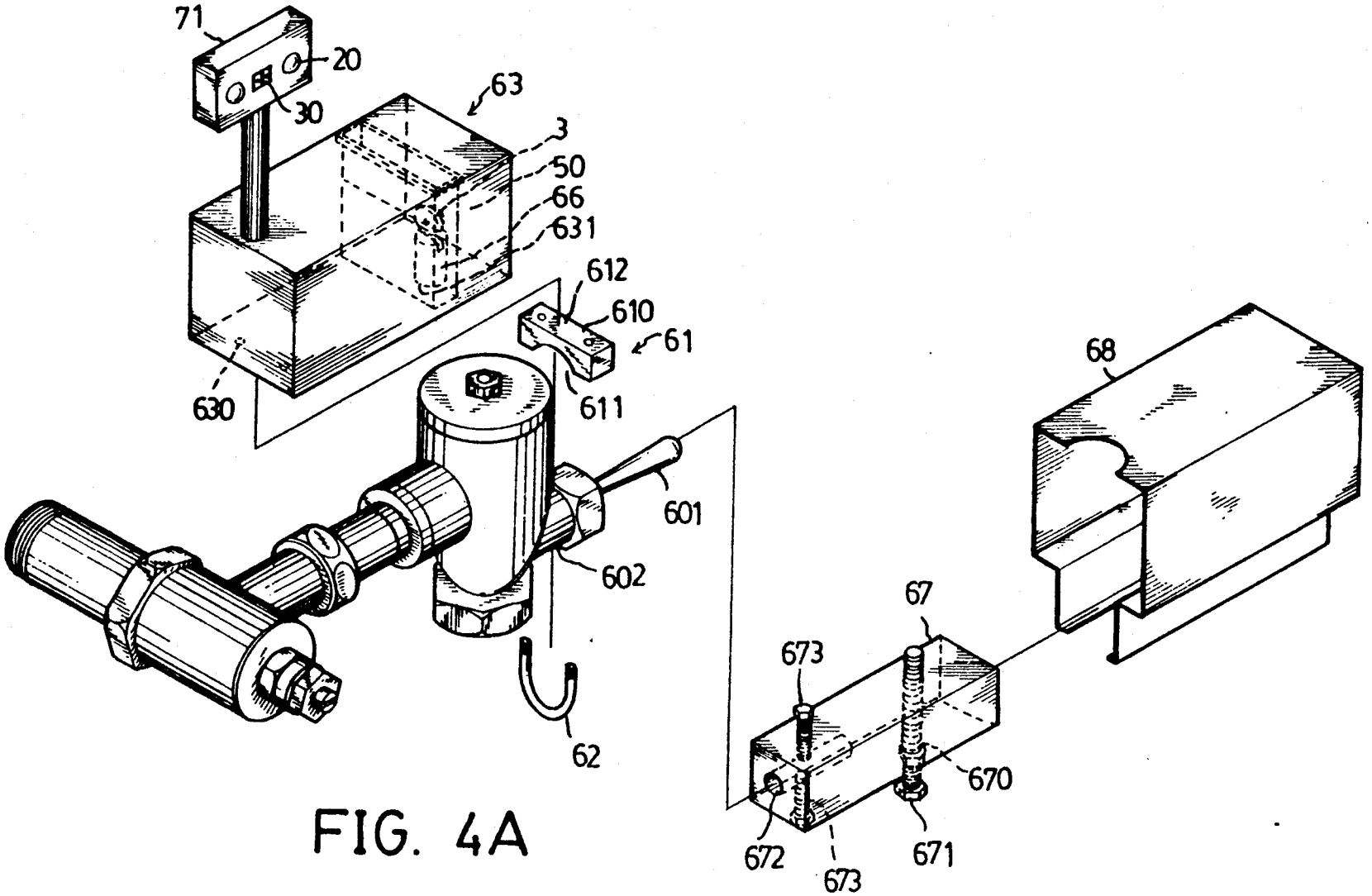
FIG. 4A is an exploded view showing a mechanical adapter for practicing the toilet flushing controller on a tankless-type toilet flushing device.
Figure 4B:
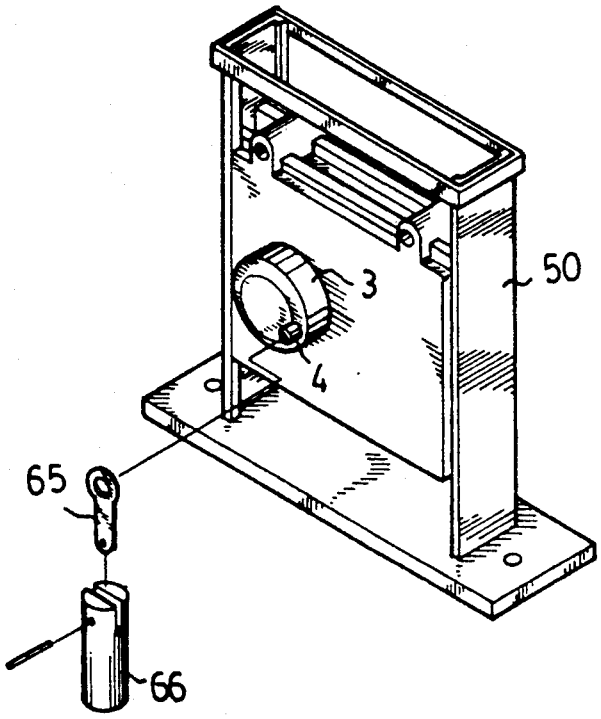
FIG. 4B is a detailed view of a pumping motor used in FIG. 4A.

Referring to FIG. 4A, the mechanical adapter device comprises the following elements.

A mounting means 61 has an arcuate recess portion 611 at a bottom side thereof for mating with the tubular body portion 602 of the toilet flushing device and a flat surface 612 at the top side thereof having a first pair of through holes 610 from the bottom side to the top side.

A casing means 63 for receiving said pumping motor 50 therein having a second pair of through holes 630 at the bottom thereof substantially mating with said two through holes 610 of the mounting means 61 and a limiting hole 631 formed at the bottom of the casing means 63 just opposite to the second pair of through holes 630 by the pumping motor 50.

A U-shaped fastening member 62 penetrates the first and second pair of through holes 610 and 630 to secure the casing means 63 on the mounting means 61.

A hammer 66 is allowed to be moved up and down in a line trace limited by the limiting hole of the casing 63.

A connecting rod 65 has a first end thereof pivotally engaged to the eccentric shaft 4 and a second end thereof pivotally engaged to the hammer 66.

A lever means 67 has a socket-portion 672 therein for receiving the handle 601 and a readjustable screw 671 arranged in adjacent to the socket portion 672 exactly below and in alignment with the hammer 66. A pair of fasteners 673 are used to fasten the handle 601 from top and bottom transverse directions thereof when the latter is received in the socket portion 672.

The disk 3 and the eccentric shaft 4 of the motor 50 faces to the inner right hand side of the casing 63 as shown in dotted line.

Figure 6:
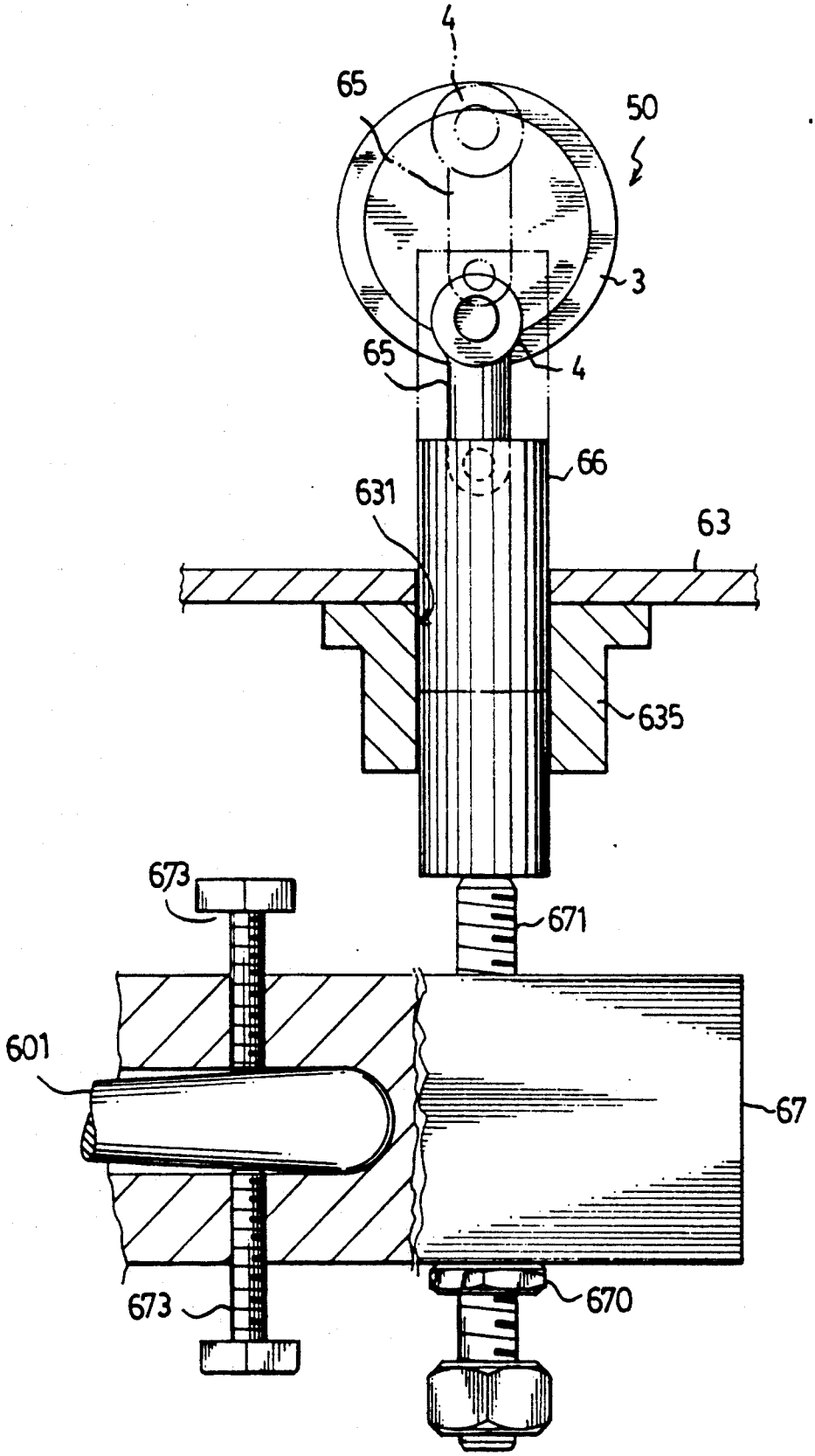
FIG. 6 is a simplified view illustrating how the adapter functioning on a handle of the tankless-type toilet flushing device.

FIG. 6 illustrates the assembly adapter, wherein the eccentric shaft 4 is changing from twelve o'clock position to six o'clock position.

FIG. 6 illustrates the detailed view of the limiting hole 631 as shown in FIG. 4A. A protruding socket 635 is attached to the bottom of the casing 63, thereby extending the length of the limiting hole 631. In normal status, the eccentric shaft 4 of the pumping motor 50 stays in twelve o'clock position, during which status the hammer 66 does not depress the screw 671 of the lever means 67. If a user stays in the toilet position in less than one minute, then after he leaves, the eccentric shaft 4 of the pumping motor 50 will be activated to stay in six o'clock position for a relatively short time period such as 3 seconds, during which time, water will be provided to clean the toilet. If a user stays in the toilet position more than one minute, after he leaves, the eccentric shaft 4 of the pumping motor 50 will be activated to stay in six o'clock position for a relatively long time period such as 15 seconds, during which time water will be provided to clean the toilet. FIG. 6 illustrates the eccentric shaft 4 moving from the twelve o'clock position to the six o'clock position. However, the relative short time and the relatively long time can be programmed and not limited to a specific value.

I claim:

1. A power-saving controller for a toilet flushing device comprising:

a DC power supply for providing required power for the whole controller having a 5-volt output and a 9-volt output;

a pyroelectricity detecting means (20) for sensing temperature from a user nearby and responding to generate a first triggering signal;

a microcomputer (10) coupled to said pyroelectricity detecting means (20) for responding to said first triggering signal and generating a second triggering signal;

an active infrared detecting means (30) coupled to said microcomputer (10) for responding to said second triggering signal and being activated to detect whether a user is in toilet position, such that when a user is in toilet position, said active infrared detecting means (30) will respond to generate a third triggering signal and feed the third triggering signal to said microcomputer (10) to start a program for time counting until the user leaves, beyond the sensing range of said infrared detecting means (30), eliminating said third triggering signal, stopping counting of said timer, and causing said microcomputer (10) to output a fourth triggering signal;

a switch means (40) having a triggering terminal (41) coupled to said microcomputer (10) for responding to said fourth triggering signal and being activated to be conductive to a ground;

a pumping motor (50) including an eccentric shaft (4) having a positive terminal connected to said 9-volt terminal of said DC power supply (60) and a negative terminal connected to said switch means (40) such that when said switch means (40) is conductive to ground, said pumping motor (50) rotates as long as said switch means (40) is conductive.

2. A power-saving controller for a toilet flushing device as claimed in claim 1, wherein said microcomputer (10) comprises:

a timer being programmably controlled to count when the third triggering signal is fed from said active infrared detecting means (30) to said microcomputer (10) and stop to count when the third triggering signal disappears;

a first input terminal (RB7) for responding to said first triggering signal and further triggering a program therein to enable said timer to count:

a reset terminal (MCLR) for responding to a low input to clear said timer therein;

a first output terminal (RB4) for outputting said second triggering signal when said microcomputer (10) receives said first triggering signal;

a second input terminal (RB0) for receiving said third triggering signal and responding to trigger said timer to start to count;

a second output terminal (RB6) for outputting said fourth triggering signal with a predetermined duty cycle to enable said motor (50) to rotate for a half circle after said third triggering signal terminates.

3. A power-saving controller for a toilet flushing device as claimed in claim 1, wherein said pyroelectricity detecting means (20) comprises a pyroelectricity sensor (21) connected to a first triggering terminal of a first transistor (25) which has an output terminal connected to a converter (22) which has an output terminal (LED) connected to a cathode of a light emitting diode (26) and also to a triggering terminal of a second transistor (23) which has a first output terminal connected to said first input terminal (RB7) of said microcomputer (10) and a second output terminal connected to a triggering terminal of a third transistor (24) which has an output terminal connected to said reset terminal (MCLR) of said microcomputer (10), such that when a user comes nearby, said pyroelectricity sensor (21) detects the presence of the user, causing a pulse to be sent to said converter (22), which in turn generates a low pulse to activate said light emitting diode (26) on, and to trigger said second transistor (23) and said third transistor (24) on, said second transistor (23) on, generating said first triggering signal and coupling said first triggering signal to said first input terminal (RB7), said third transistor (24) on, generating a low input to reset said microcomputer (10).

4. A power-saving controller for a toilet flushing device as claimed in claim 1, wherein said active infrared detecting means (30) comprising a fourth transistor (31) having a triggering terminal connected to said first output terminal (RB4) of said microcomputer (10) and an output terminal connected to an infrared transmitter 32, which further couples to an infrared receiver 33 by reflected infrared from a user in toilet position, said infrared receiver 33 being coupled to three cascaded filters (34, 35, and 36) which is further connected to an amplifier (37) and further connected to said second input terminal (RB0) of said microcomputer (10), such that after said second triggering signal is outputted from said first output terminal (RB4) of said microcomputer (10) and triggers said fourth transistor (31) to be on, Which in turn triggers said infrared transmitter (32) to transmit an infrared signal to a user's body and be reflected therefrom and received by said infrared receiver (33), said third triggering signal is generated through said filters (34, 35, and 36) and said amplifier (37) and is coupled to said second input terminal (RB0) of said microcomputer (10) to start said timer to count until said third triggering signal disappears after the user leaves the toilet position.

5. A power-saving controller for a toilet flushing device as claimed in claim 2, wherein said switch means (40) is an NPN transistor, with its base connected to second output terminal of said microcomputer (10), emitter connected to ground, and connector connected to said negative terminal of said motor (50).

6. A power-saving controller for a toilet flushing device as claimed in claim 4, wherein said active infrared detecting means (30) further comprises a multi-switch (38) connected to a plurality of reference resistors (39) for providing a gain control of said amplifier (37).

7. A power-saving controller for a toilet flushing device as claimed in claim 1 further comprises a mechanical adapter device for engaging the controller to a well known tankless-type toilet flushing device which has a handle (601) pivotally engaged to a tubular body portion (602) of the toilet flushing device for being depressed to provide water to the toilet, wherein said mechanical adapter device comprises:

a mounting means (61) having an arcuate recess portion (611) at a bottom side thereof for mating with the tubular body portion (602) of the toilet flushing device and a flat surface (612) at the top side thereof having a first pair of through holes (610) from the bottom side to the top side;

a casing means (63) for receiving said pumping motor (50) therein having a second pair of through holes (630) at the bottom thereof substantially mating with said two through holes (610) of said mounting means (61) and a limiting hole (631);

a U-shaped fastening member (62) penetrating said first and second pair of through holes (610, 630) to secure said casing means (63) on said mounting means (61);

a hammer (66) allowing to be moved up and down in a line trace limited by said limiting hole (631) of said casing (63);

a connecting rod (65) having a first end thereof pivotally engaged to the eccentric shaft (501) and a second end thereof pivotally engaged to the hammer (66); and a lever means (67) having a socket portion (672) therein for receiving said handle (601) and a readjustable screw (671) arranged in adjacent to said socket portion (672) exactly below and in alignment with the hammer (66).

* * * * *